US009822434B2

(12) United States Patent
Samuelsson et al.

(10) Patent No.: US 9,822,434 B2
(45) Date of Patent: Nov. 21, 2017

(54) FERRITIC-AUSTENITIC STAINLESS STEEL

(75) Inventors: Peter Samuelsson, Västerås (SE); Simon Lille, Avesta (SE); Jan-Olof Andersson, Krylbo (SE); Mats Liljas, Avesta (SE); Erik Schedin, Uppsala (SE); Pelle Johansson, Avesta (SE)

(73) Assignee: Outokumpu Oyj, Helsinki (FI)

( * ) Notice: Subject to any disclaimer, the term of this patent is extended or adjusted under 35 U.S.C. 154(b) by 377 days.

(21) Appl. No.: 13/140,422

(22) PCT Filed: Dec. 17, 2009

(86) PCT No.: PCT/FI2009/051005

§ 371 (c)(1),
(2), (4) Date: Jun. 16, 2011

(87) PCT Pub. No.: WO2010/070202

PCT Pub. Date: Jun. 24, 2010

(65) Prior Publication Data

US 2011/0250088 A1 Oct. 13, 2011

(30) Foreign Application Priority Data

Dec. 19, 2008 (FI) ..... 20080666

(51) Int. Cl.
*C22C 38/02* (2006.01)
*C22C 38/00* (2006.01)
(Continued)

(52) U.S. Cl.
CPC ..... *C22C 38/001* (2013.01); *C21D 8/02* (2013.01); *C21D 8/0226* (2013.01);
(Continued)

(58) Field of Classification Search
CPC ..... C22C 38/001; C22C 38/02; C22C 38/42; C22C 38/44; C22C 38/58; C21D 8/02;
(Continued)

(56) References Cited

U.S. PATENT DOCUMENTS 4,721,600 A * 1/1988 Maehara et al. ..... 420/57
4,832,765 A 5/1989 Debold et al.
(Continued)

OTHER PUBLICATIONS

Teppo Fält, International Search Report for PCT/FI2009/051005, dated Mar. 8, 2010.

*Primary Examiner* — Jie Yang
(74) *Attorney, Agent, or Firm* — Chernoff Vilhauer LLC

(57) ABSTRACT

The invention relates to a duplex stainless steel having austenitic-ferritic microstructure of 35-65% by volume, preferably 40-60% by volume of ferrite and having good weldability, good corrosion resistance and good hot workability. The steel contains 0.005-0.04% by weight carbon, 0.2-0.7% by weight silicon, 2.5-5% by weight manganese, 23-27% by weight chromium, 2.5-5% by weight nickel, 0.5-2.5% by weight molybdenum, 0.2-0.35% by weight nitrogen, 0.1-1.0% by weight copper, optionally less than 1% by weight tungsten, less than 0.0030% by weight one or more elements of the group containing boron and calcium, less than 0.1% by weight cerium, less than 0.04% by weight aluminium, less than 0.010% by weight sulphur and the rest iron with incidental impurities.

8 Claims, 1 Drawing Sheet

Figure 1:
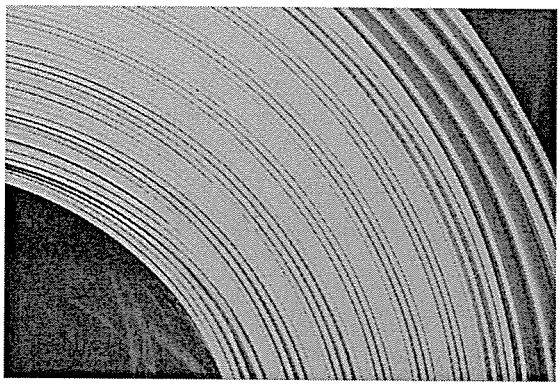

(51) Int. Cl.

| | |
|---|---|
| ***C21D 8/02*** | (2006.01) |
| ***C21D 8/06*** | (2006.01) |
| ***C21D 8/08*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 8/0273* (2013.01); *C21D 8/06* (2013.01); *C21D 8/08* (2013.01); *C22C 38/02* (2013.01); *C22C 38/42* (2013.01); *C22C 38/44* (2013.01); *C22C 38/58* (2013.01); *C21D 2211/001* (2013.01); *C21D 2211/005* (2013.01)

(58) Field of Classification Search
CPC ..... C21D 8/0226; C21D 8/0273; C21D 8/06; C21D 8/08; C21D 2211/001; C21D 2211/005
USPC ..... 420/40, 41, 57, 61, 65, 67; 148/325
See application file for complete search history.

(56) References Cited

U.S. PATENT DOCUMENTS

| | | | | |
|---|---|---|---|---|
| 5,582,656 | A | 12/1996 | Kangas | |
| 5,908,486 | A * | 6/1999 | Flinn et al. | 75/232 |
| 6,551,420 | B1 * | 4/2003 | Bergstrom et al. | 148/325 |
| 6,749,697 | B2 * | 6/2004 | Bergstrom et al. | 148/325 |
| 6,793,119 | B2 * | 9/2004 | Eijkenboom et al. | 228/119 |

* cited by examiner

FERRITIC-AUSTENITIC STAINLESS STEEL

This is a national stage application filed under 35 USC 371 based on International Application No. PCT/FI2009/051005 filed Dec. 17, 2009, and claims priority under 35 USC 119 of Finnish Patent Application No. Fl 20080666, filed Dec. 19, 2008.

The present invention relates to a duplex ferritic-austenitic stainless steel, in which the level of ferrite in the microstructure of the steel is 35-65% by volume, preferably 40-60% by volume and is economical to manufacture and has good hot workability without edge cracking in hot rolling. The steel is corrosion resistant and has high strength and good weldability as well as the raw material costs are optimised with regard to at least nickel and molybdenum contents so that the pitting resistance equivalent, PRE value, is between 30 and 36.

Ferritic-austenitic or duplex stainless steels have a history almost as long as stainless steels. A large number of duplex alloys have appeared during this period of eighty years. Already in 1930 Avesta Steelworks, now included in Outokumpu Oyj, produced castings, forgings and plates of duplex stainless steel under the name of 453S. This was thus one of the very first duplex steels and it contained essentially 26% Cr, 5% Ni and 1.5% Mo (expressed as weight percent) giving the steel a phase balance of about 70% ferrite and 30% austenite. The steel had greatly improved mechanical strength compared to austenitic stainless steels and was also less prone to intercrystalline corrosion due to the duplex structure. With manufacturing techniques of this period the steel contained high levels of carbon and no intentional nitrogen addition and the steel showed high ferrite levels in the weld areas with some reduction in properties. However, this basic duplex steel composition was gradually improved with lower carbon contents and more balanced phase ratio and this duplex steel type still exists in national standards and is available commercially. This base composition has also been the forerunner to many later developments of duplex steels.

A second generation of duplex steels was introduced in 1970's when the AOD converter process improved the possibilities to refine the steels and facilitated the addition of nitrogen to steels. In 1974 duplex steel was patented (DE patent 2255673), which was claimed to be resistant to intercrystalline corrosion in as welded condition due to a controlled phase balance. This steel was standardized under the number of EN 1.4462 and was gradually produced by several steel manufacturers. Later, research work showed that nitrogen is a crucial element controlling the phase balance during welding operations and the wide range of nitrogen both in above the patent and in the standard could not give a consistent result. Today this optimised duplex stainless steel grade 1.4462 has a dominating position produced in large tonnage of many suppliers. A trade name for this steel is 2205. The knowledge of the role of nitrogen has also been used in later developments and modern duplex steels contain moderate to high nitrogen levels depending on the overall composition.

Duplex steels can today be divided into lean, standard, and superduplex grades. In general lean duplex steels exhibit a pitting corrosion resistance on level with austenitic stainless steels having the standard numbers EN 1.4301 (ASTM 304) and EN 1.4401 (ASTM 316). With much lower nickel content than the austenitic counterparts the lean duplex grades can be offered at a lower price. One of the first lean duplex steels was patented in 1973 (US patent 3736131). One application intended for this steel was cold-headed fasteners and with low nickel content and instead manganese. Another lean duplex alloy that was patented in 1987 (U.S. Pat. No. 4,798,635) was essentially free from molybdenum for good resistance in certain environments. This steel is standardized as EN 1.4362 (trade name 2304) and is partly used to replace austenitic stainless steels of the type EN 1.4401. Also this 2304 steel can suffer from problems of high ferrite level in the weld zone as fairly low nitrogen levels can be obtained with this grade. Outokumpu patented new lean duplex steel (LDX 2101) in 2000 (EP patent 1327008) with the objective to show a certain desirable property profile with low raw material costs competing with type EN 1.4301 austenitic stainless steel.

Among the so-called standard duplex steels the earlier mentioned steel 1.4462 (trade name 2205) is the most established and dominating grade. To meet various property requirements combined with price considerations several versions of this grade exist today. This can be a problem if this steel is specified different properties can be obtained.

One attempt to provide a low cost alternative to type EN 1.4401 (ASTM 316) austenitic stainless steel as well as for the duplex stainless steel grade 2205 was made in U.S. Pat. No. 6,551,420, which relates to a duplex stainless steel being weldable and formable and having greater corrosion resistance than EN 1.4401 and is particularly advantageous for service in chloride containing environments. In the examples of this U.S. Pat. No. 6,551,420 two compositions are described so that the ranges for each element are in the following as % by weight: 0.018-0.021% carbon, 0.46-0.50% manganese, 0.022% phosphorous, 0.0014-0.0034% sulphur, 0.44-0.45% silicon, 20.18-20.25% chromium, 3.24-3.27% nickel, 1.80-1.84% molybdenum, 0.21% copper, 0.166-0.167% nitrogen and 0.0016% boron. The pitting resistance equivalent value, PRE, is for these example compositions between 28.862 and 28.908. When comparing these ranges with the claimed ranges of the U.S. Pat. No. 6,551,420 described in the following table 2, the claimed ranges are very broad to the ranges of the examples.

It is also known from the US patent application 2004/0050463 a high manganese duplex steel with good hot workability (chemical composition in table 2). In this publication it is said that if the content of copper is limited to 0-1.0% and the content of manganese is increased, hot workability is improved. Further, this US patent application mentions that in a molybdenum-containing duplex stainless steel, as the manganese content increases, hot workability is improved, when the molybdenum content is constant. In the case where the manganese content is constant and the molybdenum content increases, hot workability becomes worse. This US patent application also describes that in a high manganese containing duplex stainless steel, tungsten and manganese have a synergistic effect on improvement of hot workability. However, this US patent application also says that in a low manganese-containing duplex stainless steel, as the tungsten content increases, hot workability is lowered.

An important factor beside the chemical composition, determining the hot workability of duplex stainless steels is the phase balance. Experience has shown that duplex stainless steel compositions with high austenite contents exhibit low hot workability and while higher ferrite contents are beneficial in this respect. As high ferrite contents have an adverse effect on weldability it is crucial for optimizing the phase balance in the design of duplex stainless steel alloys. The US patent application 2004/0050463 does not describe anything about the ferrite or austenite portion in the microstructure and, therefore, the ferrite contents were calculated using the thermodynamical database ThermoCalc TCFE6 for the duplex stainless steels "speci17" and "speci28", which hot workability is compared in this US patent application. The calculated ferrite contents at three temperatures for these "speci17" and "speci28" are in the table 1

TABLE 1

Ferrite contents in U.S. patent application 2004/0050463

| Steel | Ferrite content [%] 1050° C. | 1150° C. | 1250° C. |
|---|---|---|---|
| Speci 17 | 28 | 36 | 49 |
| Speci 28 | 60 | 69 | 83 |

In addition to that the "speci17" and "speci28" compared in the US patent application 2004/0050463 are different in compositions, the table 1 clear shows that these steels "speci17" and "speci28" are totally different in phase balance, which is sufficient to explain the difference in hot workability between these two alloys. It is thus obvious that other properties are also different.

The compositions of the duplex stainless steels mentioned in the patents above are collected in the following table 2. The table 2 also contains the values for the pitting resistance equivalent, PRE, calculated using the formula:

$$PRE=\%\ Cr+3.3\times\%\ Mo+16\times\%\ N \quad (1).$$

It is therefore of commercial interest to find a duplex stainless steel to being a cost effective alternative to the stainless steel grades with a certain specific property profile for mechanical, corrosive and welding properties.

The object of the present invention is to eliminate drawbacks of the prior art and to achieve an improved ferritic-austenitic duplex stainless steel, which is economical to manufacture without edge cracking in hot rolling and is corrosion resistant and has good weldability. The essential features of the invention are enlisted in the appended claims.

The present invention relates to a duplex stainless steel having austenitic-ferritic microstructure of 35-65% by volume, preferably 40-60% by volume ferrite, which steel contains 0.005-0.04% by weight carbon, 0.2-0.7% by weight silicon, 2.5-5% by weight manganese, 23-27% by weight chromium, 2.5-5% by weight nickel, 0.5-2.5% by weight molybdenum, 0.2-0.35% by weight nitrogen, 0.1-1.0% by weight copper, optionally less than 1% by weight tungsten and the rest iron with incidental impurities. Preferably, the duplex stainless steel having austenitic-ferritic microstructure contains 0.01-0.03% by weight carbon, 0.2-0.7% by weight silicon, 2.5-4.5% by weight manganese, 24-26% by weight chromium, 2.5-4.5% by weight nickel, 1.2-2% by weight molybdenum, 0.2-0.35% by weight nitrogen, 0.1-1% by weight copper, optionally less than 1% by weight tungsten, less than 0.0030% by weight one or more elements of the group containing boron and calcium, less than 0.1% by weight cerium, less than 0.04% by weight aluminium, to maximum 0.010% by weight and preferably maximum 0.003% by weight sulphur as well as preferably maximum 0.035% phosphorus and the rest iron with incidental impurities. More preferably, the duplex stainless steel of the invention having austenitic-ferritic microstructure contains less than 0.03% by weight carbon, less than 0.7% by weight silicon, 2.8-4.0% by weight manganese, 23-25% by weight chromium, 3.0-4.5% by weight nickel, 1.5-2.0% by weight molybdenum, 0.23-0.30% by weight nitrogen, 0.1-0.8% by weight copper, optionally less than 1% by weight tungsten, less than 0.0030% by weight one or more elements of the group containing boron and calcium, less than 0.1% by weight cerium, less than 0.04% by weight aluminium, to maximum 0.010% by weight and preferably maximum 0.003% by weight sulphur as well as preferably maximum 0.035% phosphorus and the rest iron with incidental impurities.

The present invention relates to a certain type of economical stainless steel where the raw material costs are optimised considering the large price fluctuation of certain important alloying elements, such as nickel and molybde-

TABLE 2

Chemical compositions and PRE values of duplex stainless steels calculated by formula (1)

| Alloy/patent (trade name) | C | Si | Mn | Cr | Ni | Mo | Cu | N | Other | PRE (1) |
|---|---|---|---|---|---|---|---|---|---|---|
| 453S | <0.08 | | — | 26 | 5 | 1.5 | — | — | | 30.95 |
| DE2255673 (2205) | <0.03 | <0.8 | <2.0 | 18-26 | 2-8 | 1.6-5 | — | 0.06-0.20 | | 24.24-45.7 |
| U.S. Pat. No. 3,736,131 | <0.06 | <1.0 | 4-11 | 19-24 | <3 | — | <0.5 | 0.12-0.26 | <0.5 Co | 20.92-28.16 |
| U.S. Pat. No. 4,798,635 (2304) | <0.06 | <1.5 | <4 | 21-24.5 | 2-5.5 | 0.01-1 | <1 | 0.05-0.3 | | 21.83-32.6 |
| EP1327008 (LDX 2101) | <0.07 | 0.1-2.0 | 3.0-8.0 | 19-23 | 0.5-1.7 | <1.0 | <1.0 | 0.15-0.30 | <2 W | 21.4-31.1 |
| U.S. Pat. No. 6,551,420 | <0.06 | 0-2 | 0-3.75 | 15-25 | 3-6 | 1.4-2.5 | <0.5 | 0.14-0.35 | <0.2 Co | 21.86-38.85 |
| US 2004/0050463 | <0.1 | 0.05-2.2 | 2.1-7.8 | 20-29 | 3.0-9.5 | <5 | 0-1.0 | 0.08-0.5 | 1.2-8 W | 21.28-53.5 |

The US patent application 2004/0050463 uses in the specification for corrosion resistance a PREN (pitting resistance equivalent number) which is calculated using the formula (2)

$$PREN=\%\ Cr+3.3\times(\%\ Mo+0.5\%\ W)+30\times\%\ N \quad (2),$$

where the factor (% Mo+0.5% W) is limited to the range $0.8<(\%\ Mo+0.5\%\ W)<4.4$. A target for the steels of this US patent application is that PREN calculated with the formula (2) is greater than 35 in order to have high corrosion resistance. The steels of the US patent application 2004/0050463 have better corrosion resistance than for instance the 2205 duplex stainless steel, but these steels have high manganese, nickel and tungsten contents for increased hot workability. These alloyed components, especially nickel and tungsten, make the steel more expensive than for instance the 2205 duplex stainless steel.

Further, there are currently large problems to manufacture duplex stainless steel hot rolled coils without edge cracking, which is attributed to loss in ductility with lower temperatures. The edge cracking gives loss in process yield as well as problems with various damages of the process equipment.

num. More particularly the present invention comprises an economical alternative with improved corrosion and strength properties compared to the widely used austenitic stainless steels of the types EN 1.4404 (ASTM 316L) and EN 1.4438 (ASTM 317L). The invention also provides an economical alternative to the frequently used duplex stainless steel EN 1.4462 (2205). The steel according to the present invention can be manufactured and be used in a very wide range of products such as plate, sheet, coil, bars, pipes and tubes as well as castings. Products of the present invention find applications in several user segments such as process industry, transportation and civil engineering.

In accordance with the invention it is of great importance that the all alloy additions to duplex stainless steel are in good balance and are present in optimal levels. Furthermore, to obtain good mechanical properties, high corrosion resistance, and proper weldability it is desirable to limit the phase balance in the duplex stainless steel of the invention. For these reasons solution annealed products of this invention should contain 40-60% by volume of ferrite or austenite. Based on the stabilized microstructure in the steel of the invention the pitting resistance equivalent, the PRE value calculated with the formula (1), is between 30 and 36, preferably between 32 and 36, more preferably between 33 and 35. Further, the duplex stainless steel of the invention the critical pitting temperature (CPT) for corrosion is more than 40° C. With regard to mechanical properties, the yield strength, $Rp_{0.2}$, of the duplex stainless steel of the invention is more than 500 MPa.

The duplex stainless steel of the invention is further presented in the effects of separate elements in % by weight:

Carbon addition stabilizes the austenite phase in duplex steels, and if kept in solid solution, it improves both strength and corrosion resistance. The carbon content should therefore be higher than 0.005%, preferably higher than 0.01%. Because of its limited solubility and the detrimental effects of carbide precipitates, the carbon content should be restricted to maximum 0.04%, and preferably maximum 0.03%.

Silicon is an important addition to steels for the metallurgical refining process and should be larger than 0.1%, and preferably 0.2%. Silicon also stabilizes ferrite and intermetallic phases why it should be added to maximum 0.7%.

Manganese is used together with nitrogen as an economical substitute for the expensive nickel to stabilize the austenite phase. As manganese improves the nitrogen solubility it can reduce the risk of nitride precipitation in the solid phase and porosity formation in the liquid phase such as in casting and welding. For these reasons the manganese content should be larger than 2.5%, preferably larger than 2.8%. High manganese levels can increase the risk of intermetallic phases and the maximum level should be 5% and preferably maximum 4.5% and more preferably 4%.

Chromium is the most important addition in stainless steels, including duplex steels because of its crucial effect on both local and uniform corrosion resistance. It favours the ferrite phase and increases the nitrogen solubility in the steel. To achieve sufficient corrosion resistance chromium should be added to minimum 23% and preferably minimum 24%. Chromium increases the risk of intermetallic phase precipitation at temperatures between 600 and 900° C. as well as spinodal decomposition of the ferrite between 300 and 500° C. Therefore the steel of the present invention should not contain more than 27% chromium, preferably maximum 26% chromium and more preferably maximum 25%.

Nickel is an important but expensive addition to duplex steels for stabilizing the austenite and improving the ductility. For economical and technical reasons the nickel content should be restricted to an interval of 2.5 to 5%, preferably 3 to 4.5%.

Molybdenum is a very costly alloying element that strongly improves corrosion resistance and stabilizes the ferrite phase. To utilize its positive effect on pitting corrosion resistance molybdenum should be added with minimum 1%, preferably with minimum 1.5%, to the steel according to present invention. As molybdenum also increases the risk of intermetallic phase formation the level should be maximized to 2.5% and preferably less than 2.0%.

Copper has week austenite stabilizing effect and improves the resistance to uniform corrosion in acids such as sulphuric acid. Copper has been known to suppress formation of intermetallic phase with more than 0.1%. Present investigations show that 1% copper to the steel of the invention resulted in larger amount of intermetallic phase. For this reason the amount of copper should be less than 1.0%, preferably less than 0.8%.

Tungsten has an influence on duplex steels very similar to that of molybdenum and it is very common to use both elements to improve corrosion resistance. As tungsten is expensive the content should not be larger than 1%. The maximum content of molybdenum plus tungsten (% Mo+½% W) should be 3.0%.

Nitrogen is a very active element interstitially dissolved mainly in the austenite phase. It increases both the strength and the corrosion resistance (especially pitting and crevice corrosion) of duplex steels. Another crucial effect is its strong contribution to the austenite reformation during welding for producing sound welds. To be able to utilize these benefits of nitrogen it is necessary to provide sufficient solubility of nitrogen in the steel and in this invention this is made through the combination of high chromium and manganese with moderate nickel content. To achieve these effects a minimum of 0.15% nitrogen in the steel is required and preferably at least 0.20% nitrogen, more preferably at least 0.23% nitrogen. Even with optimised composition for nitrogen solubility there is an upper limit for the solubility in this invention above which the risk of nitride or pore formation is increased. Therefore, the maximum nitrogen content should be less than 0.35% and preferably less than 0.32%, more preferably less than 0.30%.

Boron, calcium and cerium can be added in small quantities in duplex steels to improve hot workability and not too high levels as this can deteriorate other properties. The preferred levels are for boron and calcium, less than 0.003% and for cerium less than 0.1%.

Sulphur in duplex steels deteriorates hot workability and can form sulphide inclusions that influence pitting corrosion resistance negatively. It should therefore be limited to less than 0.010% and preferably less than 0.005% and more preferably less than 0.003%.

Aluminium should be kept at a low level in the duplex stainless steel of the invention with high nitrogen content as these two elements can combine and form aluminium nitrides that will deteriorate impact the toughness. Therefore the aluminium content should be maximized to less than 0.04% and preferably maximum less than 0.03%.

Figure 2:
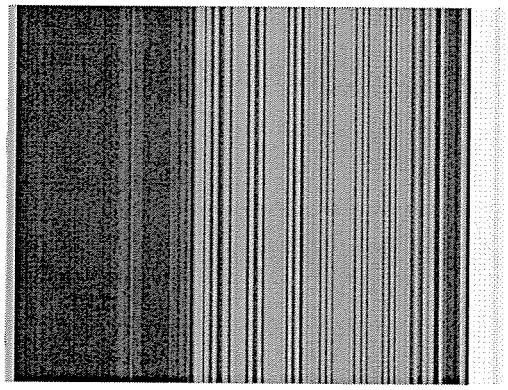

The duplex stainless steel of the invention is further described in the test results, which are compared with two reference duplex stainless steels in tables and in one drawing wherein FIG. 1 shows coil edges made of the duplex stainless steel of the invention, and FIG. 2 shows coil edges made of the full-scale reference grade.

For the property tests of the duplex stainless steel of the invention a series of 30 kg laboratory heat alloys A to F as well as Ref1 and Ref2 were produced in a vacuum induction furnace with compositions as listed in Table 3. Alloys Ref1 and Ref2 are typical compositions of two commercial grades AL2003 (similar to the grade described in the U.S. Pat. No. 6,551,420) and 2205 (EN 1.4462) respectively. The 100 mm square ingots were conditioned, re-heated and forged to approximately 50 mm thickness and then hot rolled down to 12 mm thick strips. The strips were re-heated and further hot rolled to 3 mm thickness. The hot rolled material was solution annealed at 1050° C. and pickled for various tests. Welding trials were performed with gas tungsten arc (GTA) welding on 3 mm material using 22-9-3 LN welding filler material. The heat input was 0.4-0.5 kJ/mm.

TABLE 3

Chemical compositions of tested heats

| Alloy | C | Si | Mn | P | S | Cr | Ni | Mo | Cu | N | W |
|---|---|---|---|---|---|---|---|---|---|---|---|
| A | 0.031 | 0.48 | 3.87 | 0.013 | 0.004 | 24.7 | 2.65 | 1.53 | 0.17 | 0.251 | 0.01 |
| B | 0.015 | 0.47 | 1.59 | 0.013 | 0.001 | 24.43 | 4.06 | 1.56 | 0.18 | 0.25 | 0.01 |
| C | 0.018 | 0.29 | 3.85 | 0.012 | 0.003 | 24.06 | 3.95 | 1.72 | 0.12 | 0.283 | 0.01 |
| D | 0.011 | 0.31 | 2.72 | 0.015 | 0.007 | 23.81 | 4.13 | 1.71 | 0.13 | 0.307 | 0.01 |
| E | 0.019 | 0.32 | 4.08 | 0.024 | 0.002 | 23.71 | 4.12 | 1.71 | 0.96 | 0.245 | 0.01 |
| F | 0.018 | 0.31 | 4.09 | 0.016 | 0.004 | 23.64 | 4.08 | 1.72 | 0.16 | 0.253 | 0.9 |
| G | 0.025 | 0.36 | 3.00 | 0.022 | 0.001 | 23.92 | 3.66 | 1.61 | 0.39 | 0.279 | 0.01 |
| Ref1 | 0.02 | 0.54 | 0.67 | 0.013 | 0.002 | 21.66 | 3.56 | 1.78 | 0.23 | 0.166 | 0.01 |
| Ref2 | 0.018 | 0.41 | 1.43 | 0.021 | 0.001 | 22.07 | 5.67 | 3.18 | 0.2 | 0.171 | 0.01 |
| Ref3 | 0.013 | 0.38 | 1.50 | 0.021 | 0.001 | 22.22 | 5.76 | 3.18 | 0.25 | 0.185 | 0.04 |

The alloy G and Ref3 are the full-scale heats and these alloys G and Ref3 were tested separately from the laboratory heats. The Ref3 is a full-scale heat of the Ref2.

The laboratory heat alloys A to F as well as Ref1 and Ref2 were evaluated regarding mechanical properties in solution-annealed condition. Tensile tests were performed on 3 mm sheet material. For the full-scale material the test was carried out on 6 mm annealed material. The results are listed in Table 4. All tested alloys according to present invention have yield strength $Rp_{0.2}$ above 500 MPa, valid for the thickness range and the tested coil process route, and higher than the reference materials of the commercial steels. The fracture strength Rm of heat alloys according to the invention is well above 700 MPa, preferably above 750 MPa, and fracture A50 elongation is greater than 25%, preferably more than 30%.

TABLE 4

Mechanical properties of tested heats

| Alloy | Rp0.2 [MPa] | Rp1.0 [MPa] | Rm [MPa] | A50 [%] |
|---|---|---|---|---|
| A | 567 | 617 | 749 | 31 |
| B | 528 | 594 | 741 | 34 |
| C | 539 | 603 | 769 | 38 |
| D | 518 | 596 | 775 | 36 |
| E | 523 | 593 | 748 | 29 |
| F | 549 | 606 | 763 | 34 |
| G | 561 | 632 | 802 | 34 |
| Ref1 | 498 | 542 | 690 | 35 |
| Ref2 | 502 | 563 | 715 | 36 |

Evaluations of the microstructures in the laboratory heat alloys A to F as well as Ref1 and Ref2 were made using light optical microscopy. The ferrite contents were measured in 3 mm thick material after solution annealing at 1050° C. using quantitative metallography. The results are listed in Table 5. An important feature of a duplex stainless steel of the invention is to show a good microstructure in both as solution annealed in the parent metal (PM) and as welded condition (WM). Steel A shows high ferrite levels in both conditions, which can be explained by a too low Ni content in the steel. Steel B shows acceptable ferrite contents but the nitride level in the welded condition is high, which can be explained by the low manganese content in the steel. With the steel according to the invention a good phase balance has been achieved in both solution annealed and as welded conditions. Further, the amount of nitride precipitates in the heat-affected zone (HAZ) is clearly lower in the steel of this invention.

TABLE 5

Metallographic investigations

| Alloy | Ferrite % PM | Ferrite % HAZ | Ferrite % WM | Nitride in HAZ |
|---|---|---|---|---|
| A | 66 | 84.3 | 80.5 | high |
| B | 57 | 75.2 | 73.3 | high |
| C | 47 | 69.3 | 69.6 | low |
| D | 49 | 63.3 | 59.1 | low |
| E | 51 | 77 | 74.1 | low |
| F | 53 | 76.9 | 72.4 | low |
| G | 49 | 71 | 68.7 | low |
| Ref1 | 56 | 83.6 | 79.5 | high |
| Ref2 | 51 | 81.1 | 75.5 | med |

In order to evaluate the resistance to pitting corrosion of different laboratory heat alloys A to F as well as Ref1 and Ref2 the critical pitting corrosion temperature, CPT was measured for the heat alloys A to F as well as Ref1 and Ref2. The CPT is defined as the lowest temperature at which pitting occurs in a specific environment. CPT of the different laboratory heat alloys A to F as well as Ref1 and Ref2 was measured on 3 mm material of solution annealed condition and in a 1M NaCl solution using ASTM G150 standard procedure. The results are listed in Table 6. The steels of the invention have CPT in excess of 40° C. The table 6 also contains the PRE value calculated using the formula (1) for the laboratory heat alloys A to F and for the reference materials Ref1 and Ref2.

TABLE 6

| Critical Pitting Temperatures obtained according to ASTM G150 with PRE values | | |
|---|---|---|
| Alloy | PRE | CPT [° C.] |
| A | 34 | 36 |
| B | 34 | 45 |
| C | 33 | 44 |
| D | 33 | 47 |
| E | 33 | 43 |
| F | 35 | 47 |
| G | 34 | 43 |
| Ref1 | 30 | 39 |
| Ref2 | 35 | 60 |

This level of critical pitting resistance also compares favourably with that of several, more costly, commercial steels as listed in Table 7.

TABLE 7

| Critical Pitting Temperatures (ASTM G150) of some steel grades | | |
|---|---|---|
| Material | PRE | CPT [° C.] |
| This invention | 33-35 | ≥40 |
| EN 1.4362 | 26 | 25 |
| EN 1.4462 | 34 | 50 |
| EN 1.4438 | 28 | 35 |
| EN 1.4401 | 26 | 10 |

The test results described for the full-scale alloy G in the tables 4, 5 and 6 are based on the tests, which were carried out on the material having a thickness of 6 mm and received from the full-scale production. The annealing of this alloy G was done in the laboratory circumstances.

An important property of duplex stainless steels is the ease of the manufacture of these steels. For various reasons it is difficult to evaluate such effects on laboratory heats, as the steel refining is not optimal in small scale. Therefore, in addition to the laboratory heat alloys A to F for the duplex stainless steel of the invention above, the full-scale heats (90 ton) were produced (Alloy G and Ref3 in the table 3). These heats were produced using conventional electric arc furnace melting, AOD processing, ladle furnace refining and continuous casting into slabs with a section of 140×1660 mm.

For the manufacture of the duplex stainless steel the hot workability was evaluated of full-scale alloy G of the invention and of Ref3 using hot tensile testing of cylindrical specimens cut from the continuously cast slab and heat treated for 30 minutes at 1200° C. and water quenched. The results are shown in Table 8 where the workability (evaluated as area contraction (ψ [%]) and flow stress (σ [MPa]) for alloy G are compared with a full-scale reference of Ref3, where the specimens for both the alloy G of the invention and the Ref3 were prepared in the same way. The area contraction, ψ, was determined by measuring the sample diameter before and after the tensile test. The flow stress, σ, is the necessary sample stress to attain a deformation rate of $1s^{-1}$. Table 8 also contains the calculated ferrite contents at three temperatures using the thermodynamical database ThermoCalc TCFE6.

TABLE 8

| Results of hot tensile testing | | | | | | |
|---|---|---|---|---|---|---|
| | Alloy G | | | Ref3 | | |
| Temperature [° C.] | ψ [%] | σ [MPa] | Ferrite [%] | ψ [%] | σ [MPa] | Ferrite [%] |
| 950 | 92.5 | 133 | | 73.3 | 146 | |
| 1000 | 90.0 | 110 | | 71.6 | 116 | |
| 1050 | 90.9 | 95 | 39 | 75.5 | 91 | 38 |
| 1100 | 93.5 | 81 | | 82.0 | 77 | |
| 1150 | 96.0 | 65 | 51 | 89.4 | 55 | 51 |
| 1200 | 97.1 | 55 | 66 | 98.0 | 46 | 68 |

The alloy G, according to the invention, shows a surprisingly good hot ductility in the entire hot working temperature range as compared to the reference material (Ref3) that exhibits a loss in ductility (ψ) towards lower temperatures. Because the phase balance between austenite and ferrite is similar in the compared Alloy G and Ref3, the different compositions of these two steels are the main cause of the different hot workability. This is a crucial property for the duplex stainless steels that will be hot rolled to coils. In order to test the edge cracking in a hot rolled coil, a 20-ton coil of the alloy G was hot rolled in a Steckel mill from 140 to 6 mm thickness resulting in very smooth coil edges as illustrated in FIGS. 1 and 2, where a comparison with a similar coil of Ref3 is shown. FIG. 1 shows coil edges for the alloy G and FIG. 2 coil edges for the Ref3.

The duplex stainless steel according to present invention shows a superior strength level to other duplex stainless steels and exhibits comparable corrosion performance to other duplex stainless steels and austenitic stainless steel alloys with higher raw material costs. It is evident that steel of the invention also possesses a balanced microstructure that makes it respond to welding cycles very favourably.

This description illustrates some important aspects of the invention. However, variations and modifications will be evident to those of ordinary skill in the art without departing from the scope and spirit of the present invention and appended claims.

The invention claim is:

1. Duple stainlesss steel having austenitic-ferritic microstructure of 35-65% by volume of ferrite and having good weldability, good corrosion resistance and good hot workability, wherein the steel contains less than 0.03 % by weight carbon, less than 0.7% by weight silicon, 2.8-4.0% by weight manganese, 23-25% by weight chromium, 3.0-4.5% by weight nickel, 1.5-2.0% by weight molybdenum, 0.23-0.30% by weight nitrogen,0.1-0.8% by weight copper, less than 1% by weight tungsten, less than 0.003% by weight one or more elements of the group containing boron and calcium, less than 0.1% by weight cerium, less than 0.04% by weight aluminum, less than 0.003% by weight sulphur and less than 0.035% phosphorus, and the rest iron with incidental impurities, wherein,the steel has an area contraction (Ψ) at the temperature range 1000-1200° C. of between 90.0 and 97.1%.

2. Duplex stainless steel according to claim 1, wherein the yield strength of the steel is at least 500 MPa.

3. Duplex stainless steel according to claim 1, wherein the fracture strength of the steel is more than 700 MPa.

4. Duplex stainless steel according to claim 1, wherein the critical pitting temperature, CPT, of the steel is more than 40 ° C.

5. Duplex stainless steel according to claim 1, wherein the pitting resistance equivalent, PRE, of the steel is between 30 and 36.

6. Duplex stainless steel according to claim 5, wherein the pitting resistance equivalent, PRE, of the steel is between 32 and 36.

7. Duplex stainless steel according to claim 6, wherein the pitting resistance equivalent, PRE, of the steel is between 33 and 35.

8. The duplex stainless steel according to claim 1, wherein the steel contains 0.025% by weight carbon, less than 0.36% by weight silicon, 3.0% by weight manganese, 23.92% by weight chromium, 3.66% by weight nickel, 1.61% by weight molybdenum, 0.279% by weight nitrogen, and 0.39% by weight copper.

* * * * *